US005290022A

United States Patent [19]

Sabatier et al.

[11] Patent Number: 5,290,022

[45] Date of Patent: Mar. 1, 1994

[54] DEVICE FOR FEEDING PIECES OF MAIL, ESpECIALLY UNSEALED PIECES, FROM A STACK AND A METHOD OF OPERATING THE DEVICE

[75] Inventors: Louis Sabatier, Montelier; Olivier Roch, Valence; Jean-Luc Astier, Tain, all of France

[73] Assignee: Compagnie Generale D'Automatisme CGA-HBS, Bretigny sur Orge, France

[21] Appl. No.: 918,037

[22] Filed: Jul. 24, 1992

[30] Foreign Application Priority Data

Jul. 25, 1991 [FR] France ..... 91 09431

[51] Int. Cl.[5] ..... B65H 5/08

[52] U.S. Cl. ..... 271/12; 271/104; 271/94; 271/265

[58] Field of Search ..... 271/10-12, 271/104, 121, 94, 265

[56] References Cited

U.S. PATENT DOCUMENTS

| | | | |
|---|---|---|---|
| 3,025,052 | 3/1962 | Gutteling | 271/104 |
| 3,235,249 | 2/1966 | Street et al. | 271/104 |
| 3,260,520 | 7/1966 | Sugden | 271/104 |
| 3,669,446 | 6/1972 | Derc et al. | 271/104 |
| 3,847,383 | 11/1974 | Wojtowicz et al. | 271/104 |
| 4,345,752 | 8/1982 | Nakamura et al. | 271/104 |
| 4,357,007 | 11/1982 | Mens Franciscus et al. . | |
| 4,893,804 | 1/1990 | Sasage et al. . | |
| 5,154,407 | 10/1992 | Shidara | 271/104 |

FOREIGN PATENT DOCUMENTS

| | | | |
|---|---|---|---|
| 140943 | 6/1987 | Japan | 271/104 |
| 92150 | 4/1989 | Japan | 271/104 |

OTHER PUBLICATIONS

Gutteling, J., "Device For Separating And Carrying Off Sheets", *IBM Tech. Discl. Bull.*, vol. 2, No. 5, pp. 16-17 (Feb. 1960).

Anderson et al., "Document Feeder and Separator", *IBM Tech Discl. Bull.*, vol. 6, No. 2, pp. 32-33 (1963).

*Primary Examiner*—H. Grant Skaggs

*Attorney, Agent, or Firm*—Sughrue, Mion, Zinn, Macpeak & Seas

[57] ABSTRACT

A device for feeding flat pieces of mail from a stack of mail pieces in edgewise abutment with a registration wall has a feeder for feeding pieces of mail off the stack which is located in front of the first mail piece on the stack. The feeding feeder effects translation of the pieces of mail at a speed $V_1$ perpendicular to the stack 1. A transfer feeder transfers the piece of mail fed off the stack at a speed $V_2$. An anti double feed device is disposed between the two feeders. The anti double feed device is a retention device acting on a face of the piece of mail as soon as such piece of mail is taken hold of by the transfer feeder and having a retentive force which is lower than the translation force of the transfer feeder. The speed $V_1$ of the translation first feeder is lower than the speed $V_2$ of the transfer feeder.

8 Claims, 4 Drawing Sheets

DEVICE FOR FEEDING PIECES OF MAIL, ESPECIALLY UNSEALED PIECES, FROM A STACK AND A METHOD OF OPERATING THE DEVICE

The present invention concerns a device for feeding flat objects from a stack, in particular pieces of mail, especially unsealed pieces of the nature of publicity or other brochures, the device comprising a feed device for a stack of mail pieces in edgewise abutment with a registration wall, means for feeding off the stack located in front of the free face of the first mail piece on the stack and formed by a device effecting translation at a speed $V_1$ perpendicular to the stack, transfer means for transferring the mail piece fed off the stack at a speed $V_2$ and an anti double feed device disposed between these two means.

BACKGROUND OF THE INVENTION

Such known devices comprise as the means for feeding off the stack a device for translating the mail pieces, formed for example by a rotary perforated drum in which a partial vacuum is created and which entrains the first mail piece with a speed $V_1$. A transfer device is located downstream from the means for feeding off the stack, this transfer device acting at a speed $V_2$ identical with $V_1$. A device for avoiding double feeds is usually located between these two devices, being formed by a brush means or by a hinged flap.

As a general rule, anti double feed devices do not work efficiently.

This is mainly the case when the mail pieces being handled are unsealed objects, of the nature of publicity or other brochures. These brochures may be composed for example of a sheet folded into several panels or of several leaves connected together like a small booklet. Any conventional device for feeding from a stack and based on braking the mail piece coming off in a double feed, then works badly and causes buckling or tearing of the mail pieces fed off the stack.

The invention enables these problems in feeding off a stack and of double feeds of unsealed mail pieces to be overcome.

SUMMARY OF THE INVENTION

To this end, the anti double feed device is a retention device acting on the face of the mail piece as soon as a mail piece is taken hold of by the transfer means and whose retentive force is lower than the translation force of the transfer means, and the speed $V_1$ of the device effecting translation is lower than the speed $V_2$ of the transfer means.

It can be said that, in practice, the number of double feeds in which the front edges of the two mail pieces coincide is very small.

Such cases occur with a frequency lower than the currently-tolerated frequency of double feeds. In general, there is a gap between the front edges of the two mail pieces involved in a double feed.

Because of its retention device, the device retains the second mail piece in the case of a double feed and allows normal passage of the mail piece fed off the stack in the case of no double feed. The positioning, the control and the effectiveness of the devices for feeding off the stack and for retention ensure that unsealed mail pieces are not damaged.

This freedom from damage is based on two principles:

the mail piece fed off the stack is speeded up progressively, in two stages, making it possible to reduce the suddenness with which it is fed off the stack, which makes it possible to handle unsealed mail pieces.

the retention device is rendered operative at the instant when the front edge of the mail piece is taken hold of by the transfer device.

The way the system is controlled ensures that the retention device is not rendered operative so long as the front edge is not entrained by the transfer device, thereby avoiding opening a mail piece under the opposing actions of the device for feeding off the stack acting on the rear edge of the mail piece and of the retention device retaining the front part of this mail piece.

The double-fed mail piece, if it exists, is stopped by the retention device. There is no risk that it will be damaged because it is not in contact with the device for feeding off the stack.

When the separation of the two mail pieces is confirmed by a detector, said stopped mail piece is engaged in its turn by the transfer device. In a preferred embodiment, in order to control the flow of the mail pieces fed off the stack three detectors are located in the path of the mail piece fed off the stack, comprising:

a first detector located between the jogging edge and the retention device;

a second detector located near to the retention device; and a third detector located in line with the point at which the transfer means effect active entrainment.

The device can further have at least one of the following characteristics:

the means for feeding off the stack is located on one side of the plane of the registration wall and the retention device is located on the other side;

the retention device is formed by a vacuum head;

the means for feeding off the stack is formed by a perforated belt guided and driven by pulleys and associated with a vacuum head located behind the belt;

the transfer means is formed by two endless belts associated to provide a nipping action; and a low pressure chamber is located near to and upstream of the means for feeding off the stack.

The invention also concerns a method of operating the device for feeding off a stack, according to which:

1) the means for feeding off the stack is activated and a mail piece is translated, the retention device being out of action;

2) when the second detector detects a mail piece, the retention device is activated after a delay ensuring that the first mail piece is taken hold of by the transfer means; and a) if the first detector does not detect a second mail piece, the means for feeding off the stack is reactivated after a delay and when the second detector no longer detects the mail piece, the retention device is deactivated and the cycle recommences at the point 2).

b) if the first detector detects a second mail piece, when the second detector no longer detects a mail piece, the retention device is deactivated and the means for feeding off the stack is reactivated after a delay and the cycle recommences at the point 2).

c) if the first and second detectors detect a second mail piece, when the third detector no longer detects the mail piece, the retention device is deactivated and the means for feeding off the stack is reactivated; when the third detector then detects the second mail piece, the retention device is reactivated and the means for feeding off the stack is deactivated and the cycle is recommenced at the point a), b) or c).

When vacuum heads are employed, the activation or deactivation of the means for feeding off the stack and of the retention device is effected by starting up or stopping their respective vacuum heads.

DETAILED DESCRIPTION

Figure 1:
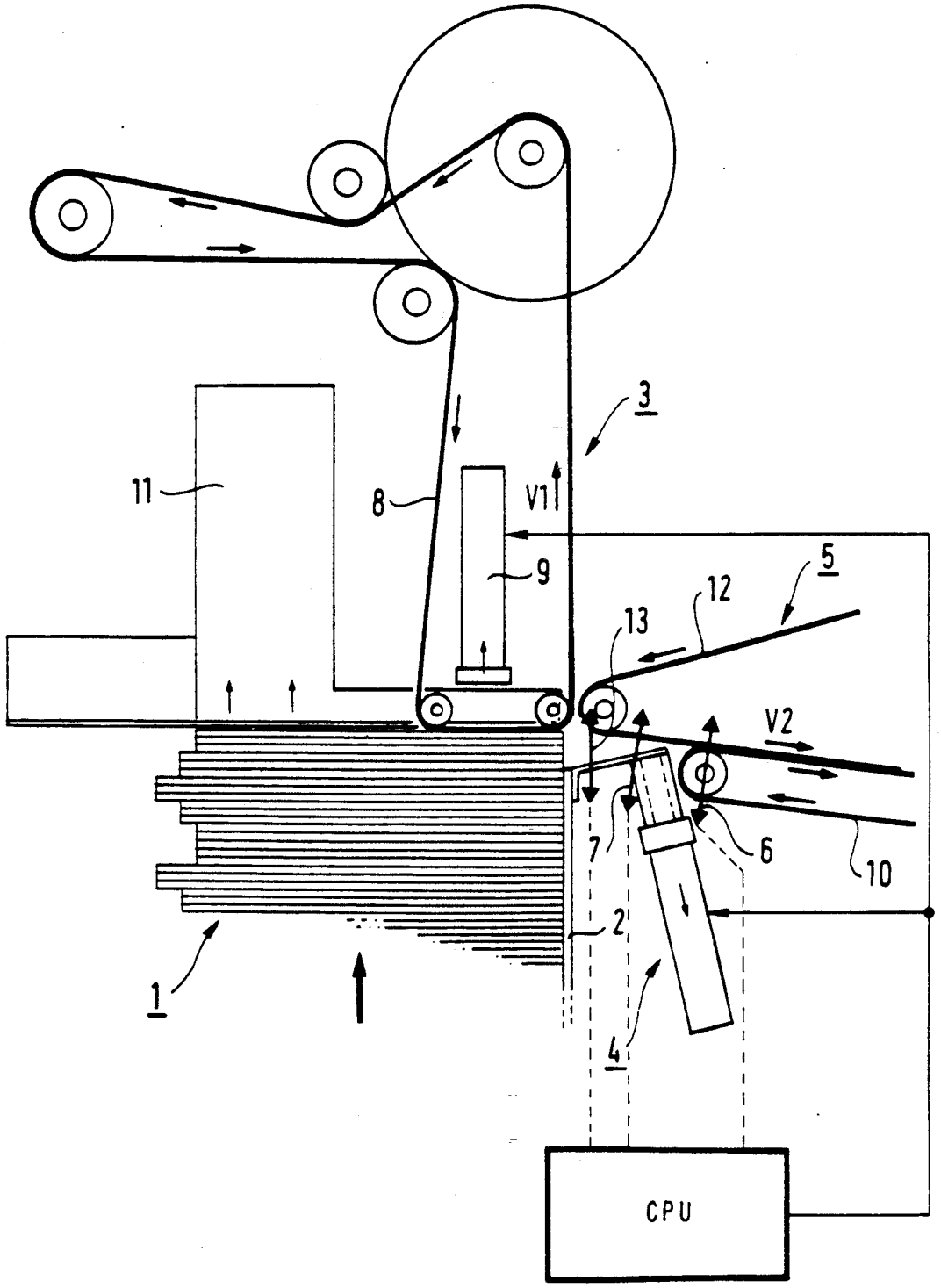
FIG. 1 is a schematic, side elevational view of a feeding device forming a preferred embodiment of the invention.

The latter represents a device for feeding from a stack in accordance with the invention in a view from above.

The device comprises in essence:

a substantially horizontal feed device for a pile of mail pieces 1 in edgewise abutment with a substantially vertical registration wall 2;

means 3 for feeding the first mail piece off the stack located in front of the face of the first mail piece of the stack 1 and formed by a device effecting translation at a speed $V_1$ perpendicular to the stack 1; this device is constituted by a perforated endless belt 8 guided and driven by pulleys and is associated with a vacuum head 9 located on the rear side of the belt 8, over the path of the mail pieces;

a retention device 4 formed by a vacuum head acting on the rear face of the mail piece fed off the stack; and transfer means 5 operating at a speed $V_2$ greater than $V_1$ and formed by two belts 10, 12 guided and driven by pulleys and acting by nipping the mail pieces.

The partial vacuum of the device 4 is such that its retentive force is lower than the translating force by the nipping of the transfer means 5.

The means 3 for feeding off the stack is located on one side of the plane of the jogging edge 2 and the retention device 4 and the transfer means 5 are located on the other side.

Detectors 6, 7, 13 formed by photoelectric sensors are located in the path of the mail piece fed off the stack and sense passage of the same.

The first detector 13 is situated downstream of and close to the registration wall 2.

The second detector 7 is situated further downstream of the registration wall 2 but preferably upstream of the vacuum head 4.

The third detector 6 is still further downstream, close to the nip of the belts 10, 12 of the transfer means 5.

The means 3 for feeding off the stack entrains the mail piece at the speed $V_1$ as far as the nip of the transfer means 5, where the mail piece is given the speed $V_2$. By way of example, $V_1$ may be 2 m/s and $V_2$ 3.2 m/s.

The operation of the device is controlled by means of signals of the detectors 6, 7, 13 fed to a control device such as a central processing unit CPU from which control signals are sent selectively to vacuum heads 4 and 9 as follows:

the first mail piece is entrained by the means 3 for feeding off the stack, the vacuum head 9 being actuated;

when the front edge of this mail piece is detected by the sensor 7, the vacuum head 4 is activated, after a delay, ensuring that the piece of mail fed off the stack is taken hold of by the transfer means 5; and when the front edge of this mail piece is detected by the sensor 6, the vacuum head 9 is deactivated.

There are then three possibilities:

1) There is no second double-fed mail piece and no second mail piece has been advanced in front of the sensor 13 by friction or impact.

Figure 2:
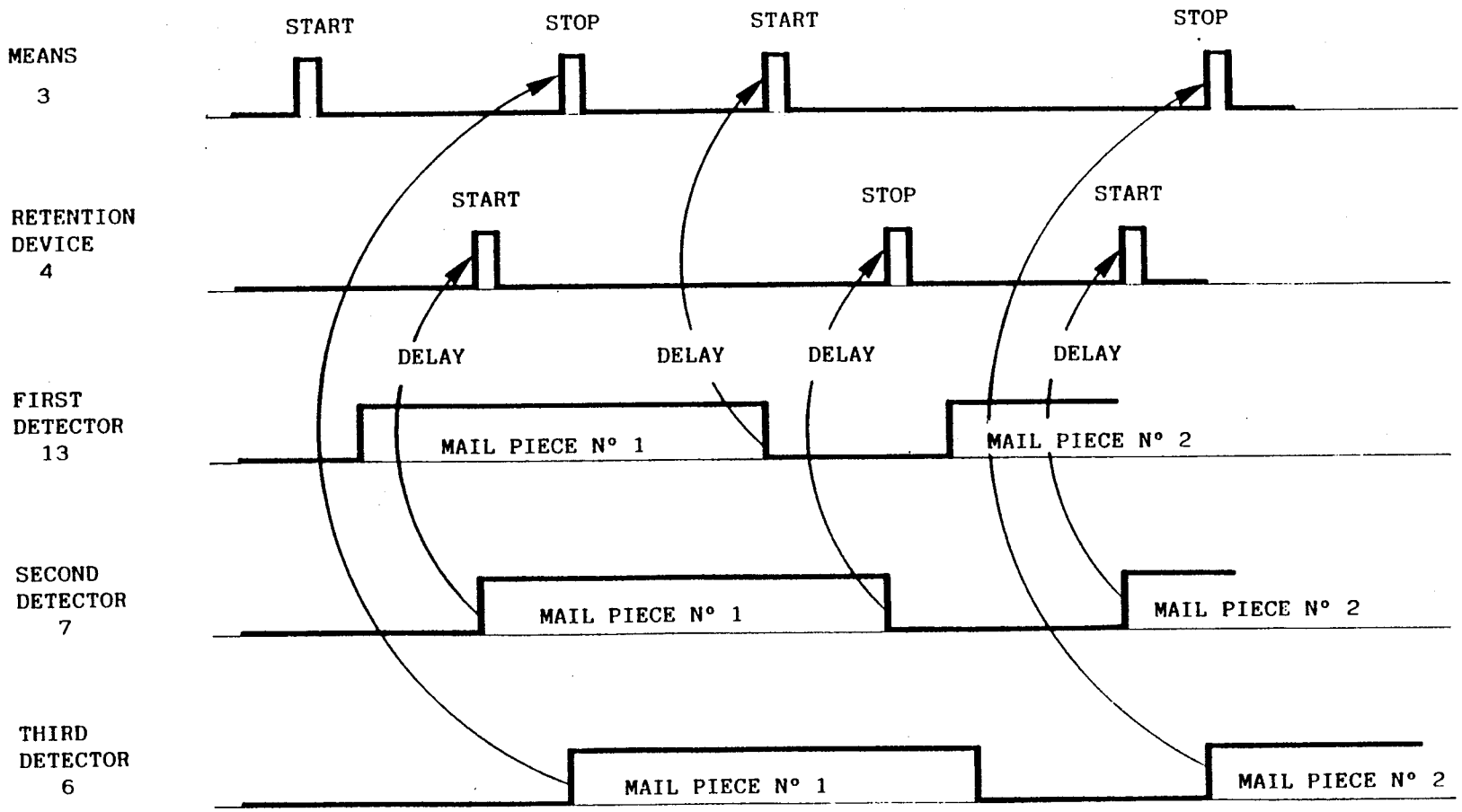
FIG. 2 is a flow diagram of a control mode of the feeding device of FIG. 1 under conditions wherein the second mail piece has not advanced beyond the first detector.

In this case as illustrated in FIG. 2, the rear edge of the mail piece fed off the stack ceases to obscure the sensor 13, starting a delay at the end of which the head 9 is reactivated to feed the following mail piece off the stack.

Moreover, the rear edge of the mail piece fed off the stack ceases to obscure the sensor 7, deactivating the head 4.

2) There is no second double fed mail piece but a second mail piece has advanced in front of the sensor 13 by friction or impact.

Figure 3:
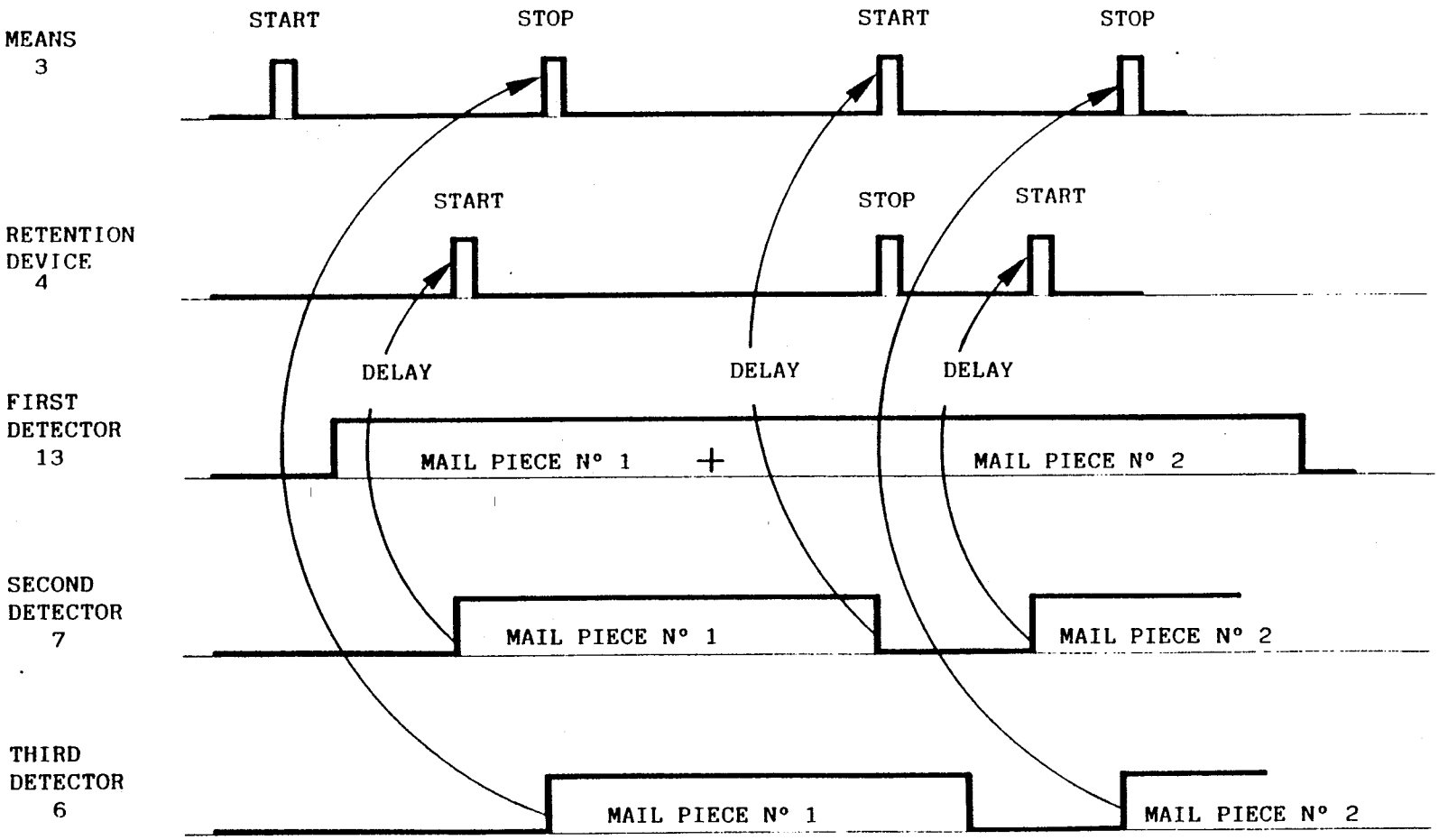
FIG. 3 is a flow diagram of a control mode for the feeding device of FIG. 1 wherein a delay is initiated, prior to reactivating the feeding of a following mail piece.

In this case in accordance with FIG. 3, the rear edge of the mail piece fed off the stack ceases to obscure the sensor 7, deactivating the head 4 and starting a delay, at the end of which the head 9 is reactivated for feeding the following mail piece off the stack.

3) A second mail piece retained by the head 4 is a double feed, obscuring the sensors 13 and 7.

Figure 4:
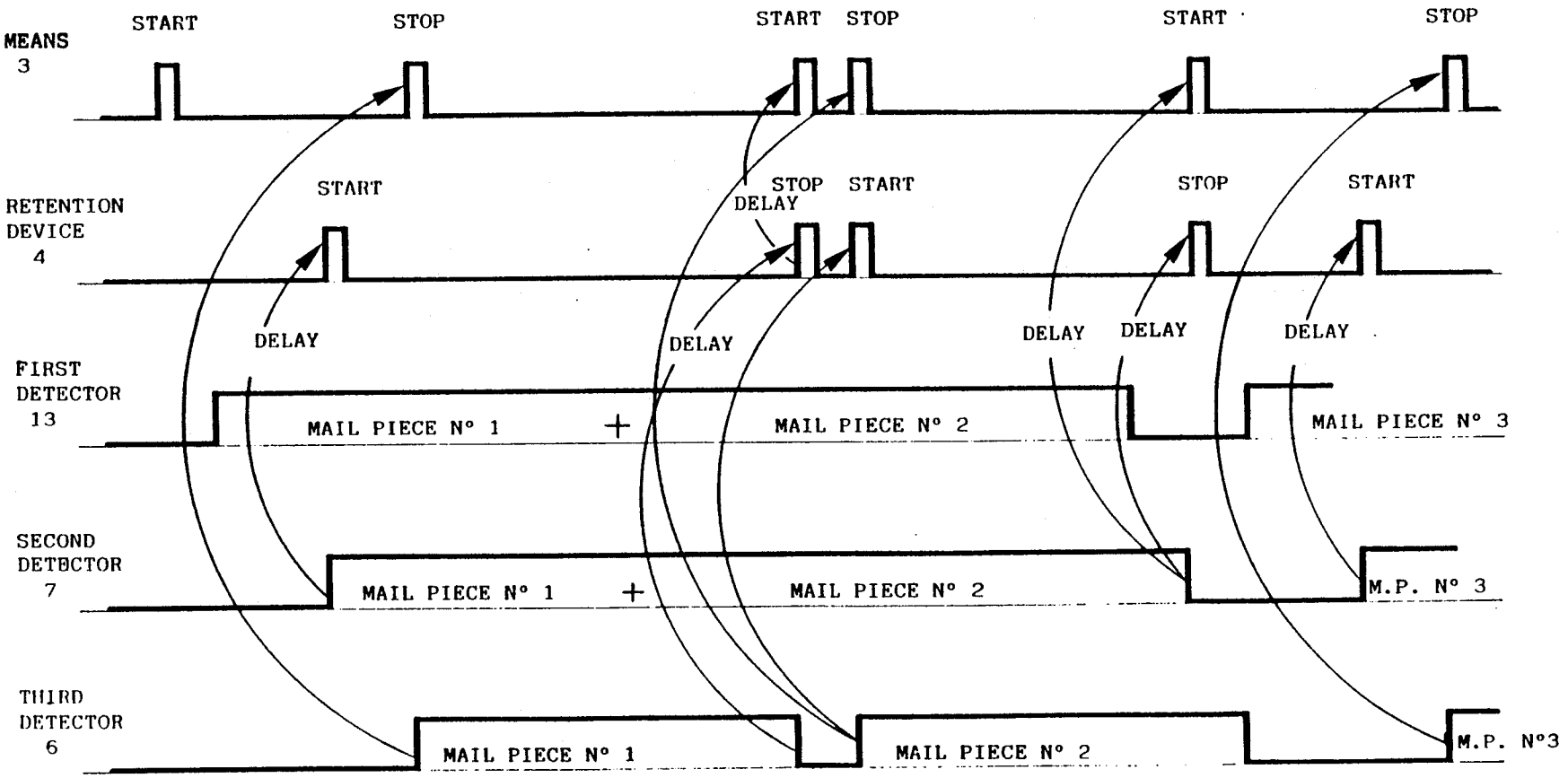
FIG. 4 is a flow diagram of a control mode for the feeding device of FIG. 1 involving a second double-fed mail piece with a delay initiated to separate the second fed mail piece from the first fed mail piece.

In this case, FIG. 4, the rear edge of the mail piece fed off the stack ceases to obscure the sensor 6, starting a delay, at the end of which, the head 4 is deactivated and the head 9 is reactivated.

The second mail piece is then brought up to speed $V_2$. Its front edge obscures the sensor 6, which has the effect of reactivating the head 4 and of deactivating the vacuum head 9.

The rear edge of the second mail piece enables the reactivation of the head 9 and the deactivation of the head 4, depending on the states of the sensors 13 and 7, according to the possibilities described above and applying to the third mail piece.

The delays referred to above, $V_1$ and $V_2$, and the positions of the sensors 13, 7, 6 and of the devices 9, 4, 5, are all chosen to maximize the flow of the objects fed off the stack and to allow feeding off the stack with a constant space between mail pieces, regardless of their lengths.

A chamber 11 at a vacuum pressure is fitted beside the means 3 for feeding off the stack, upstream thereof, to pre-condition the mail pieces to be fed off the stack.

We claim:

1. A device for feeding flat pieces of mail, said device comprising: means for supporting a stack of mail pieces in edgewise abutment with a registration wall; means for feeding said pieces of mail sequentially off the stack, said feeding means being located in the path of the first mail piece on the stack and effecting translation of said piece of mail at a speed $V_1$ perpendicular to the stack; transfer means for transferring the mail piece fed off the stack at a speed $V_2$; an anti double feed device disposed between said feeding means and said transfer means;

said anti double feed device being a retention device acting on a face of a mail piece as soon as said mail piece is taken hold of by said transfer means and having a retention force lower than a translation force of the transfer means, and wherein the speed $V_1$ of the feeding means effecting translation is lower than the speed $V_2$ of the transfer means; wherein said detectors are located in the path of a mail piece fed off the stack and comprise:

a first detector located upstream of the registration wall and the retention device;

a second detector located proximate to the retention device; and a third detector located at the point of engagement of the piece of mail with the transfer means, and said feeding device further comprising a control unit operatively coupled to said detectors and to said feeding means and said retention device for controlling the feeding means and said retention device in response to signals received from said detectors.

2. A device according to claim 1, wherein the means for feeding pieces of mail off the stack is located on one side of a plane defined by the registration wall and the retention device is located on the opposite side of said plane.

3. A device according to claim 1, wherein the retention device is a vacuum head.

4. A device according to claim 1, wherein said means for feeding pieces of mail off the stack comprises a perforated endless belt guided by motor driven pulleys passing over said vacuum head located on one side of the endless belt opposite to a second side of the belt in contact with said first piece of mail.

5. A device according to claim 1, wherein said transfer means comprises two endless belts mounted in juxtaposition and defining a nip therebetween.

6. A device according to claim 1, further comprising a chamber located in proximity to and being open to said first piece of mail upstream said means for feeding said pieces of mail off the stack.

7. A method of operating a device for feeding flat pieces of mail from a stack, said method comprising supporting said stack of pieces of mail in edgewise abutment with a retention wall, feeding said pieces of mail off the stack by operating a feed device at a speed $V_1$ perpendicular to the stack; transferring the pieces of mail fed off the stack by a transfer means at a speed $V_2$; and disposing an anti double feed device between the feeding means and the transfer means, and wherein a plurality of detectors are located in the path of pieces of mail fed off the stack and comprising a first detector located between the retention wall and the retention device; a second detector located in proximity to the retention device; and a third detector located in line with a point at which the pieces of mail are entrained with the transfer means, and said method further comprises:

1) activating the means for feeding said pieces of mail off the stack and translating a piece of mail, with the retention device maintained out of action;

2) when the second detector detects a piece of mail, activating the retention device, after a delay, to ensure that the first piece of mail is taken hold of by the transfer means; and a) if the first detector does not detect a second piece of mail, reactivating the means for feeding said pieces of mail off the stack after a delay, and when the second detector no longer detects a piece of mail, deactivating the retention device and recommencing the cycle at point 2);

b) if the first detector detects a second piece of mail, when the second detector no longer detects a piece of mail, deactivating the retention device and reactivating the means for feeding pieces of mail off the stack after a delay, and recommencing the cycle at point 2;

c) if the first and second detectors detect a second piece of mail, when the third detector no longer detects the first piece of mail, deactivating the retention device and reactivating the means for feeding pieces of mail off the stack; when the third detector than detects the second mail piece, reactivating the retention device and deactivating the means for feeding pieces of mail off the stack and recommencing the cycle at point a), b) or c).

8. A method according to claim 7, for operating a device in which the retention device is formed by a vacuum head and in which said means for feeding pieces of mail off the stack is formed by a motor driven perforated endless belt guided by pulleys and having a second vacuum head located to one side of the endless belt opposite to a second side of the belt proximate to said stack, and wherein activation and deactivation of the means for feeding pieces of mail off the stack and of the retention device is effected by starting up or stopping respective ones of said vacuum heads.

* * * * *